US005666741A

United States Patent [19]

Bubik et al.

[11] Patent Number: 5,666,741

[45] Date of Patent: Sep. 16, 1997

[54] DRYING SECTION WITH ADDITIONAL PRESS NIP

[75] Inventors: Alfred Bubik, Ravensburg; Erwin Brunmair, Graz; Harald Hess, Grünkraut; Herbert Holik, Ravensburg; Werner Leitenberger, Schlier-Wetzisreute; Thomas Merath, Oberteuringen; Johann Moser, Grünkraut; Helmet Stieb, Schlier; Elmer Weisshuhn, Vogt, all of Germany

[73] Assignee: Voith Sulzer Papiermaschinen GmbH, Germany

[21] Appl. No.: 610,723

[22] Filed: Mar. 4, 1996

[30] Foreign Application Priority Data

Mar. 3, 1995 [DE] Germany ..... 195 07 374.6

[51] Int. Cl.[6] ..... F26B 11/02

[52] U.S. Cl. ..... 34/117; 34/118; 34/119; 162/359.1

[58] Field of Search ..... 34/111, 116, 117, 34/118, 119, 120, 123, 126; 162/305, 358.3, 358.4, 360.2, 360.3, 368, 370, 901

[56] References Cited

U.S. PATENT DOCUMENTS

| | | | |
|---|---|---|---|
| 3,110,612 | 11/1963 | Gottwald et al. | 34/111 |
| 3,257,268 | 6/1966 | Wrist et al. | 162/360.2 X |
| 3,468,242 | 9/1969 | Schaffrath | 34/111 |
| 4,877,487 | 10/1989 | Miller | 34/116 X |
| 5,071,513 | 12/1991 | Bluhm et al. | 34/111 X |
| 5,534,116 | 7/1996 | Karvinen et al. | 162/360.3 |
| 5,551,164 | 9/1996 | Brunnmair et al. | 34/117 |

FOREIGN PATENT DOCUMENTS 9323615 5/1993 WIPO .

*Primary Examiner*—John M. Sollecito
*Assistant Examiner*—Steve Gravini
*Attorney, Agent, or Firm*—Ostrolenk, Faber, Gerb & Soffen LLP

[57] ABSTRACT

A drying section of a paper machine includes a plurality of individual drying groups, wherein the drying cylinders of a drying group are served by 2 respective dryer wire or felt that passes over drying cylinders of the drying group and presses a web to be dried against the surface of the drying cylinders. The invention is adapted for either single tier or double tier drying groups. At least one press roll is disposed between and separates two of the drying groups. In one embodiment, the at least one press roll forms a nip with the adjacent drying cylinder, either upstream or downstream, to define a dewatering nip through which the web passes. A dewatering belt passes over the press roll in the nip. The wire for a respective drying group is guided away from the dewatering nip so that only the web and the dewatering belt pass through the press nip. In alternate embodiments, two press rolls may be disposed between the adjacent drying groups, and the two press rolls define a press nip between them. A respective dewatering belt passes over each of the press rolls. One of those press rolls may also be in contact with and define a press nip with the adjacent drying cylinder in the adjacent drying group. An open draw free path may be defined between one of the press rolls and the adjacent drying cylinder.

22 Claims, 4 Drawing Sheets

DRYING SECTION WITH ADDITIONAL PRESS NIP

BACKGROUND OF THE INVENTION

The present invention relates to a drying section of a paper machine having several drying groups wherein the quantity of drying cylinders may be reduced, particularly by including an additional press means in the drying section for drying the web.

A drying group within a drying section passes the web to be dried sequentially over a series of drying cylinders. Within a drying section, the drying groups may be either double tier, directly heating the opposite sides of the web at successive drying cylinders, or single tier, directly heating the same side of the web at successive drying cylinders.

U.S. Pat. No. 4,934,067 discloses a single tier drying section in which the web is transferred between successive single tier drying groups by bringing the dryer wires or felts of two successive drying groups together in the region of the group to group transfer and thereby bringing both wires into contact with the opposite sides of the web which lies between them. In this connection, the drier wires of the two successive single tier drying groups are conducted over suction rolls which are positioned after the last drying cylinder in the upstream group or before the first drying cylinder in the downstream group. Such devices counteract fluttering and tearing of the web in the region of transfer by avoiding a free, unsupported path or open draw of the web of paper.

To improve or increase the drying capacity, an increased number of drying cylinders are employed, possibly divided into even more drying groups, which represents a considerable expense.

SUMMARY OF THE INVENTION

The object of the present invention is to provide a drying section which, at relatively little additional expense, improves drying of the web of paper and has the smallest possible free path or open draw between successive drying groups.

One solution according to the invention comprises placing a press roll either at the downstream end of the upstream drying group or at the upstream end or beginning of the following downstream drying group. The press roll forms a dewatering press nip with the drying cylinder of the adjacent drying group.

In another solution, a respective press roll is provided at both the downstream end of one drying group and at the upstream end of the following drying group, and the two press rolls are positioned to form a dewatering press nip with each other.

In both above described embodiments, only the web of paper and at least one dewatering belt are conducted over a press roll and pass through the dewatering press nip.

Furthermore, the press roll should have a substantially smaller diameter than the drying cylinders.

The invention may be employed between either single or double tier groups or mixes thereof and may be employed at one or more of the inter-group transfers in a drying section.

The press roll used here may be developed with known sag control, making it possible to control the press profile transverse to the path of the web of paper in the manner desired. Heating the press roll from the inside and/or outside also may improve the dewatering.

To facilitate the transfer of the web of paper onto the press roll, at least one press roll should be developed as a suction roll.

If the dewatering press zone is to be formed by or between two press rolls, there are many different possible combinations, depending on the requirements for dewatering or as a function of the properties of the entering web of paper. Furthermore, the invention is not limited to forming merely one dewatering press nip between the drying groups, as more than one such nip may be defined at one transfer or even around one drying cylinder.

In order for the press rolls to participate effectively in the transfers between successive drying groups, the press rolls should be partially wrapped by the web of paper so that they influence its course.

In order to create a transfer between successive drying groups without any open draw or with only a slight open draw or free web path, it is advantageous for the dewatering belt of at least one press roll to travel together in a section with the dryer wire of the adjacent drying group for the transfer of the web of paper. For the same purpose, it is, however, also advantageous if at least one press roll is arranged in contact with, or at a slight distance from, the drying cylinder of the other adjacent drying group for the transfer of the web of paper.

The invention is not limited in its use to the connection of particular types of drying groups, although it is preferably used at the transfers in drying sections having single tier drying groups, in which the web of paper is guided together with the endless dryer wire alternately over guide rolls and the drying cylinders. In these drying groups, only one side of the web of paper is dried by direct contact with the drying cylinders. In an alternating single tier arrangement, as in above noted U.S. Pat. No. 4,934,067, the side of the web in direct contact with drying cylinders differs or alternates from one drying group to the next drying group. Particularly in such drying sections in the patent, importance is placed on providing the transfers between such drying groups without a free web path or with only a slight free path or open draw.

Other objects, features and advantages of the present invention will become apparent from the following description of the invention which refers to the accompanying drawings.

BRIEF DESCRIPTION OF THE DRAWINGS

The invention is explained below based on four embodiments. Each of FIGS. 1–4 is a diagrammatic side view of a part of a drying section of a paper machine including three drying groups, which are shown at least in part, and which differ in their development and/or include different transfers, but in each case include a dewatering press nip.

DETAILED DESCRIPTION OF EMBODIMENTS OF THE INVENTION

Figure 1:
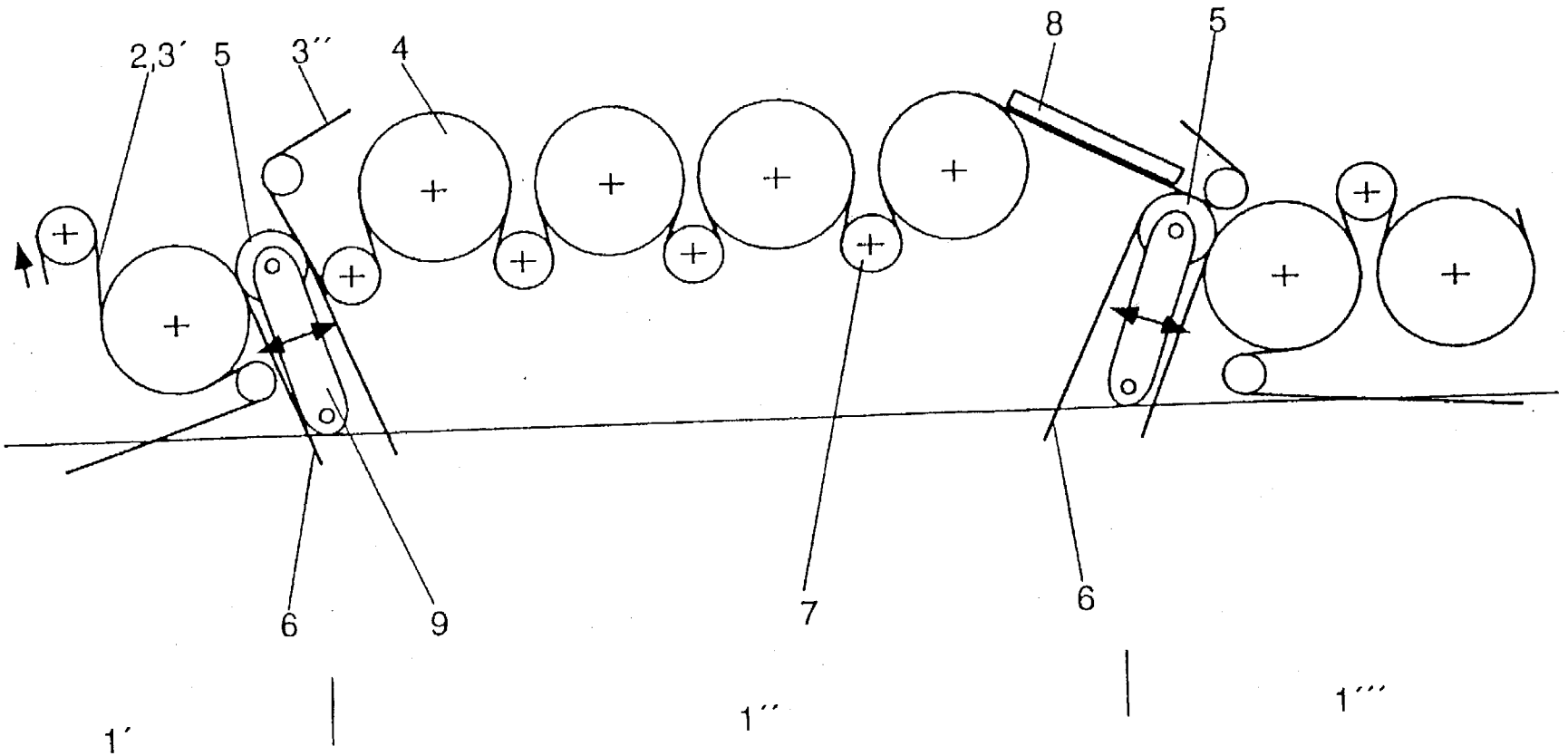
Figure 2:
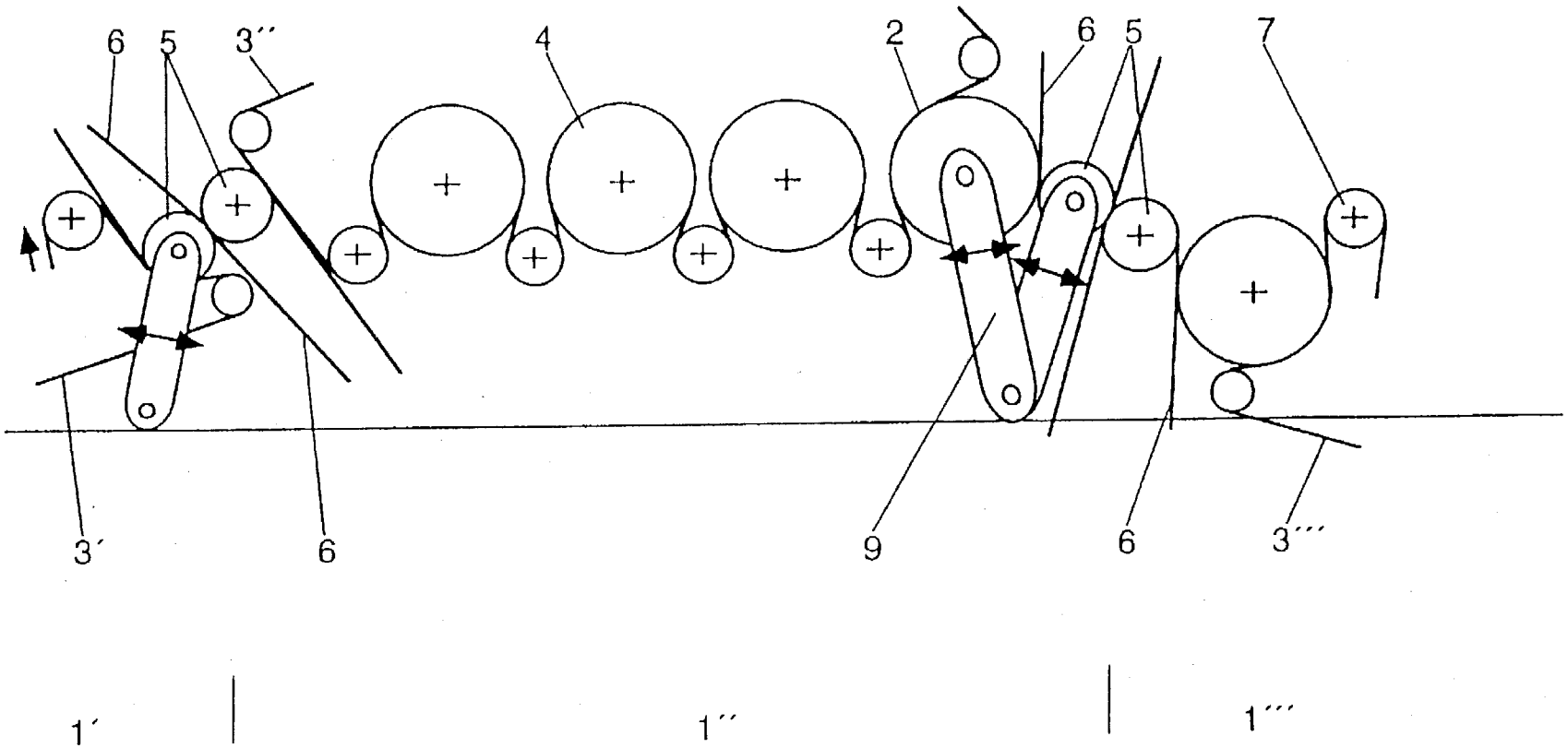
Figure 3:
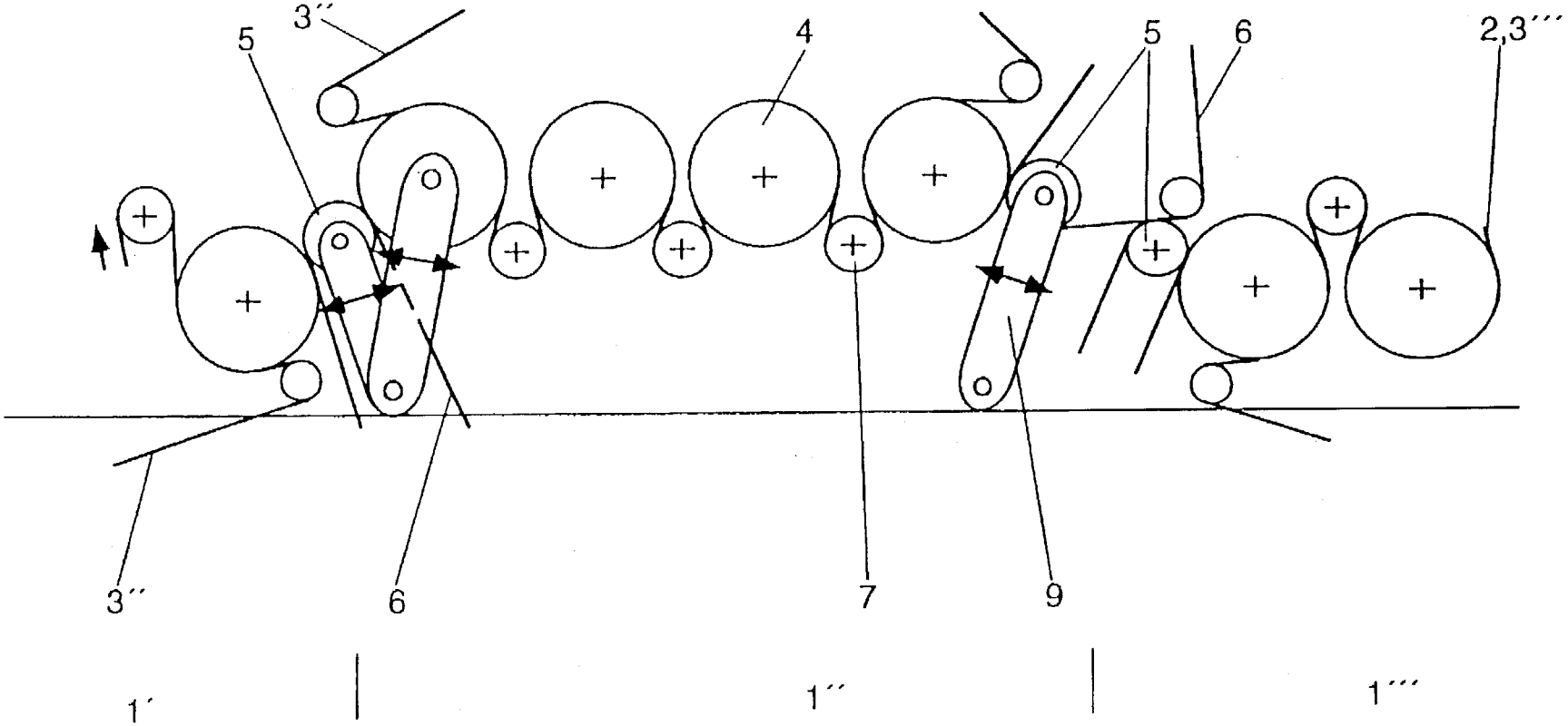
Figure 4:
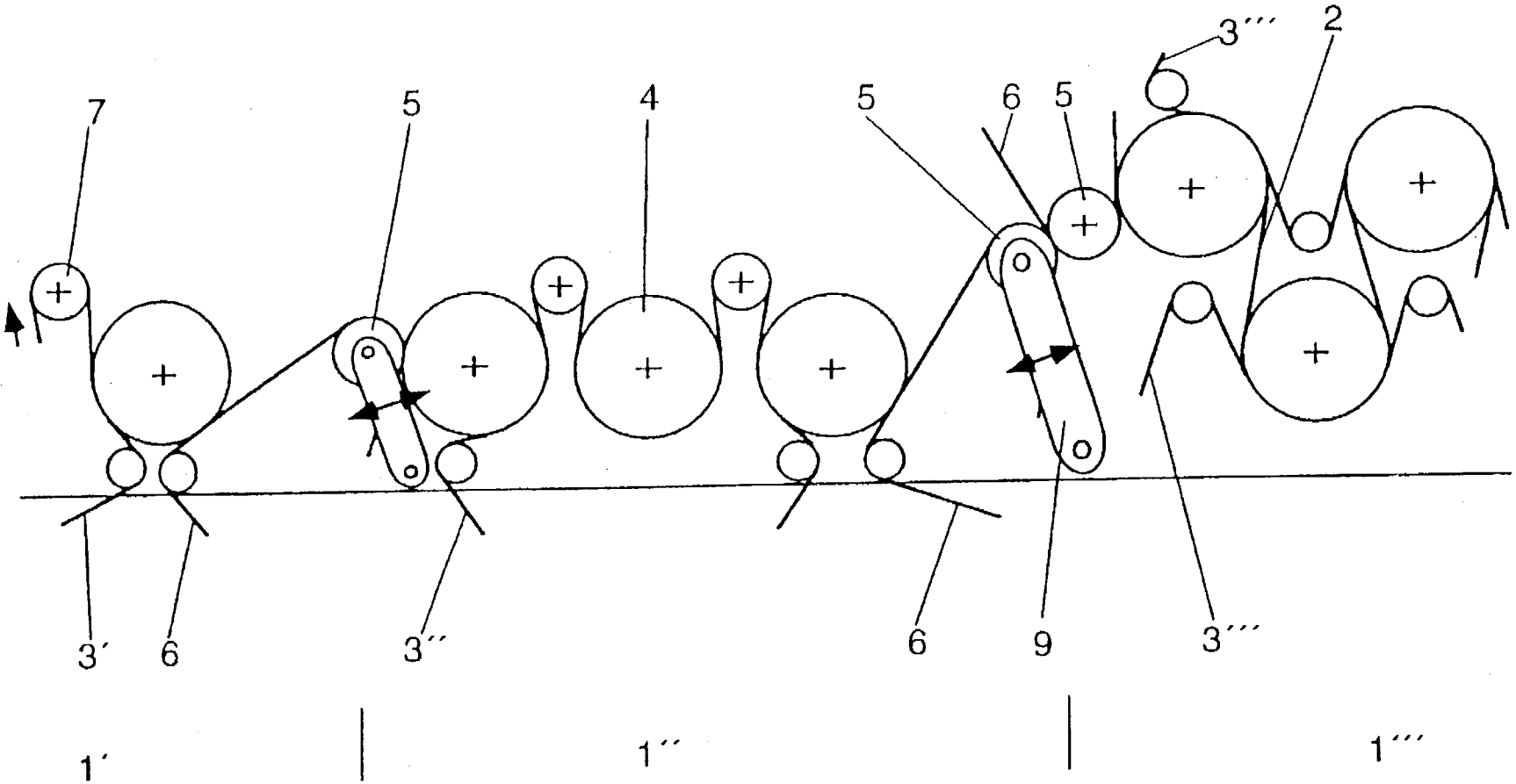

In each of the embodiments shown in FIGS. 1 to 3, the drying section is comprised of several separate drying groups of which parts or all of groups 1, 1" and 1'" and the transfer zones between the groups are shown. In each drying group, the paper web 2, together with an endless dryer wire or felt 3', 3", or 3'" associated with the respective drying group 1', 1", or 1'", is conducted through the single tier drying groups, alternately over guide rolls 7, preferably developed as suction rolls, and heated drying cylinders 4. The paper web 2 is supported on the side of the wire 3 to be present between the corresponding dryer wire 3', 3" or 3'" and the corresponding drying cylinder 4 in the group. In each of FIGS. 1–3, only one side of the paper web 2 comes into contact with the drying cylinders 4 in the drying groups 1', 1" and 1'", i.e., each drying group is illustrated as a single tier group with one row of drying cylinders and one wire. In FIG. 4, the final illustrated group is double tier and both sides of the web are directly heated. In FIGS. 1–3, that side of the web which contacts drying cylinders changes from drying group to successive drying group because the groups alternate between top felted or top wire groups and bottom felted or bottom wire groups. However, the invention is applicable to a succession of top felted or a succession of bottom felted groups. It is also applicable to a double tier or two rows of drying cylinders drying group, with two felts, one above and one below, and the web alternating between dried directly on its top then its bottom sides.

In the embodiments shown in FIGS. 1 and 3, there is a press roll 5 present at the downstream ends of both drying groups 1', 1" and/or at the beginning upstream ends of the respective following drying groups 1", 1'". The press roll cooperates with the adjacent drying cylinder 4 of the adjacent drying group 1', 1", 1'" to form a web dewatering press nip. The wires 3' and 3", etc. are guided over the drying cylinders 4 and the rolls 7 between them. At the beginning and end of each group, the wires are guided by guide rolls which direct the wires away from the transfer zones at the ends of the drying groups. As a result, only the paper web 2 along with a dewatering belt 6 guided around the press roll 5 extend through the dewatering press nip. Therefore, the wires 3 of adjacent drying groups are not acting together against the opposite sides of the web but are separated by the press roll 5.

More precisely, in FIG. 1 one press roll 5 works against the final drying cylinder 4 of the first upstream drying group 1', while another press roll 5 acts against the first drying cylinder 4 of the third drying group 1'". The respective dewatering belts 6 for both press rolls 5 travel together in each case along with the dryer wire 3" of the adjacent, second drying group 1". This transfers the web of paper without an open draw or free path in a section on the circumference of the corresponding press roll 5. The transport of the paper web 2 between the second and third drying groups 1" and 1'" via the dryer wire 3" is supported here, for example, by means of a suction box 8. The belt 6 is wrapped over the press roll 5 and an idle tension roll (not shown).

FIG. 3 shows an embodiment having a press roll 5 at the downstream end of a drying group 1', 1" and at the beginning of the respective adjacent drying group 1", 1'". Between the first and second drying groups 1' and 1", a single press roll 5 is arranged between the last drying cylinder 4 of the first drying group 1' and the first drying cylinder 4 of the second drying group 1". It is even possible to form two dewatering press nips using only one press roll 5 if, as illustrated, the press roll contacts both adjacent drying cylinders 4. But, with the shiftability of the press roll and at least one cylinder or through their selected normal positioning, contact of the press roll with only one cylinder is possible. There is in any event a positive effect that the press roll 5 is in contact with, or at least is at a slight distance from, the drying cylinder 4 of at least one of the adjacent drying groups 1' or 1" for the transfer of the paper web 2. There are two press rolls 5 between the second and third drying groups 1" and 1'". Each press roll is associated with a respective drying group 1" and 1'". Each roll has its own respective dewatering belt 6 and these belts are guided into contact with each other. The transfer of the paper web 2 between the drying groups 1" and 1'" is effected here without open draw or free path via the two dewatering belts 6 which come together in a transfer region, with the paper web 2 present between them.

In contrast, in FIG. 2, one press roll 5 is present at the downstream end of one drying group 1', 1" and another press roll 5 is present at the upstream end of the following drying group 1", 1'". The adjacent pairs of press rolls form a respective dewatering press nip with each other. Only the paper web 2 and in each case one dewatering belt 6 conducted over the press roll 5 pass through each dewatering press nip.

Between the first and second drying groups 1' and 1", the dewatering belts 6 travel with the dryer wire 3' and 3" of the adjacent drying groups 1' and 1" respectively for the transfer of the web of paper 2 in one section, preferably at the circumference of the press roll 5. However, it is also possible, as shown between the second and third drying groups 1" and 1'", for the press roll 5 to be in contact with the drying cylinder 4 of the adjacent drying group 1" or 1'" for the transfer or to be arranged at a slight distance from the drying cylinder. To be sure, as mentioned in the description of FIG. 3, one press roll 5 can also form two dewatering press nips.

The press rolls 5 are, in general, of substantially smaller diameter than the drying cylinders 4. Each press roll can be developed as a suction roll for causing the transfer to and fixing the paper web 2 onto the suction roll. This prevents the paper from continuing to travel with the wire it had been traveling on.

In all embodiments, it is also advantageous if at least one of the two press rolls 5 and/or drying cylinders 4 which form a dewatering press nip be supported movably for enabling separation of the drying groups 1', 1" and 1'" e.g. on a web break or for servicing of a wire or dryer. This separation can be effected in simple manner wherein the drying cylinder 4 and/or the press roll 5 is supported, for example, on both lateral sides of the section, on an electromechanically displaceable lever 9.

In order to be able to assure sufficient guidance of the web of paper 2 at the transfer between adjacent drying groups 1, 1", 1'", the web should partially wrap around the two press rolls 5 or the drying cylinders 4 forming a dewatering press nip. Since the press rolls 5 affect the course of the paper web 2, they can cooperate effectively in the transfers between the drying groups 1', 1", 1'", In particular, in order to equalize speeds or enable small differences in speed between the drying groups 1', 1", 1'", it may be advantageous for there to be a free path or open draw, even though only slight and short length, between the drying groups 1', 1", 1'". This is made possible by changing the position of the corresponding drying cylinder 4 or press roll 5 if the paper web travels without a dryer wire 3', 3", 3'" between the drying cylinder 4 in question and the press roll 5. However, if the paper web 2 is guided, together with a dryer wire 3', 3", 3'", to or from the press roll 5, then the free path or open draw can be easily created and influenced by a change in the path of the dryer wire 3', 3", 3'".

It is also possible to associate several dewatering belts 6 with one press roll 5 in order to improve the dewatering capacity, or else to associate only one dewatering belt 6 with several press rolls 5 in order to reduce the expense.

In order to assist in introducing the paper web 2 to succeeding drying groups, blowing devices (not shown) are preferably employed. These devices can be fastened to scraper devices or doctors (not shown) for detaching the web of paper 2.

The alternate embodiment shown in FIG. 4 makes it clear that the invention is not limited merely to special combinations of drying groups 1', 1", 1'" of the same type, e.g., single tier groups. From the large number of possibilities discussed above, two are shown here. The drying groups 1' and 1"

correspond to those single tier groups described above. The difference, however, is that they are both top felted drying groups so that the same top side of the paper web 2 comes into contact with the drying cylinders 4. In this case, a press roll 5 is present between the drying groups 1' and 1" and it forms a dewatering press nip with the first drying cylinder 4 of the second drying group 1". The paper web 2 travels from the last drying cylinder 4 of the first drying group 1' over the dewatering belt 6 of the press roll 5 to the second drying group 1".

The final drying group 1'" is a double row or double tier drying group having an upper row and a lower row of drying cylinders 4 which are spaced from each other, and the axes of the rolls are essentially so shifted with respect to each other along the machine direction that in each case a cylinder axis located in one row is located between two adjacent cylinder axes in the other row. A respective drier wire 3'" is associated with the upper row and with the lower row of drying cylinders 4. The dryer wires 3'" of each row are conducted over respective guide rollers 7 arranged in each case between two drying cylinders 4 which are adjacent to each other in a row and over the outer circumferential regions of the drying cylinders 4. The paper web 2 travels a meandering path between the upper and lower rows of drying cylinders 4 and is held on the drying cylinders 4 in each row by the respective dryer wires 3'".

At the end of the second drying group 1" and at the beginning of the third drying group 1'" there is a respective press roll 5. These two rolls together define a dewatering press nip through which the paper web 2 and in each case one dewatering belt 6 passes, wherein the belt is conducted around the press rolls 5. In this case also, it is possible, of course, for one press roll 5 to participate in forming two dewatering press nips.

Obviously, in this embodiment also, the increase in the dewatering capacity can be effected by simple means without free path or open draw or with only a slight free path or open draw.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A drying section of a paper making machine with additional web dewatering, the drying section comprising:

at least a first and a second drying group, with each of the drying groups including a plurality of heatable drying cylinders having a heatable surface; each of the drying groups having an upstream end at which a paper web enters the drying group to move through the drying group in the downstream direction, and having a downstream end where the paper web leaves the drying group;

web guide means for guiding the paper web to be dried over the surface of the drying cylinders of the drying group and to be moved from the upstream to the downstream ends of the drying group;

at least one dryer wire in each of the drying groups; wire guide means guiding the dryer wire to support the paper web against the heatable surfaces of the drying cylinders within the drying group and for the wire to move with the web through the drying group;

a press roll at one of the ends of at least one of the drying groups; a web dewatering belt passing around the press roll; and means at the end drying cylinder at the respective one end of the drying group and the press roll for urging the dewatering belt on the press roll to press on the web and against the end drying cylinder at the respective one end of the at least one drying group for defining a web dewatering nip between the press roll and the end drying cylinder; and the web guide means guiding the web through the dewatering press nip.

2. The drying section of claim 1, wherein the wire guide means of the respective drying group guides the respective dryer wire of that drying group to wrap partially around each of the drying cylinders of that drying group; the press roll being so positioned around the drying cylinder with which the press roll defines the press nip and the wire guide means so directing the dryer wire that as the web passes through the press nip, the web is pressed in contact with the dewatering belt on one side of the web and the respective drying cylinder without the dryer wire on the other side of the web.

3. The drying section of claim 2, wherein the press roll is located between the last drying cylinder of the first drying group which is upstream and the first drying cylinder of the second drying group which is downstream;

the wire guide means of one of the first and second drying groups guiding the respective dryer wire for the one dryer group into contact with the press belt for transferring the web between that dryer wire and the dewatering belt.

4. The drying section of claim 3, wherein the wire guide means of the other of the first and second drying groups guides the respective other dryer wire of the other drying group so as not to pass through the press nip.

5. The drying section of claim 4, wherein the nip is defined between the final downstream drying cylinder of the first upstream dryer group and the press roll while the dewatering belt is also in contact with the dryer wire of the second downstream dryer group.

6. The drying section of claim 1, wherein the nip is defined between the final downstream drying cylinder of the first upstream dryer group and the press roll while the dewatering belt is also in contact with the dryer wire of the second downstream dryer group.

7. The drying section of claim 1, wherein the press roll and the final downstream drying cylinder of the upstream group and the first upstream drying cylinder of the downstream group are respectively so positioned that a first press nip is defined between the press roll and the final drying cylinder of the upstream drying group and a second press nip is defined between the press roll and the first drying cylinder of the downstream drying group.

8. The drying section of claim 1, wherein the press roll is spaced a slight distance from at least one of the adjacent drying cylinders defining a short open transfer path for the web between them.

9. The drying section of claim 1, wherein the press roll is of substantially smaller diameter than the drying cylinder with which the press nip is defined.

10. The drying section of claim 1, wherein the press roll is supported for moving in position toward and away from the adjacent drying cylinder for defining the press nip or opening the press nip between them.

11. The drying section of claim 1, wherein at least one of the drying cylinders adjacent the press roll is supported for moving in position toward and away from the press for defining the press nip or opening the press nip between them.

12. The drying section of claim 1, wherein the press roll is a suction roll in part for drawing the web to the press belt.

13. The drying section of claim 1, further comprising a respective guide roll between adjacent drying cylinders in each of the first and second drying groups, for guiding the respective wire around the guide rolls and also for wrapping the wire around the drying cylinders in the drying group.

14. A drying section of a paper making machine with additional web dewatering, the drying section comprising:

at least a first and a second drying group, with each of the drying groups including a plurality of heatable drying cylinders having a heatable surface; each of the drying groups having an upstream end at which a paper web enters the drying group to move through the drying group in the downstream direction, and having a downstream end where the paper web leaves the drying group;

web guide means for guiding the paper web to be dried over the surfaces of the drying cylinders of the drying group and to be moved from the upstream to the downstream ends of the drying group;

at least one dryer wire in each of the drying groups; wire guide means guiding the dryer wire to support the paper web against the heatable surfaces of the drying cylinders within the drying group and for the wire to move with the web through the drying group;

a first and a second press roll disposed between the first and the second drying groups; a dewatering belt passing around at least one of the press rolls, the press rolls being in contact with the dewatering belt between them for defining a press nip, and the web guide means guiding the web through the press nip on the path from the first drying group to the second drying group.

15. The drying section of claim 14, further comprising first and second ones of the dewatering belts respectively wrapping the first and the second press rolls and passing through and defining the press nip between the first and second press rolls, and the web being guided through the press nip between the first and second dewatering belts.

16. The drying section of claim 14, wherein one of the press rolls and one of either the final drying cylinder of the upstream one of the drying groups and the first drying cylinder of the downstream one of the drying groups that is adjacent the one press roll are respectively so positioned that the first mentioned press nip is defined between the press rolls and a second press nip is defined between the one press roll and the adjacent drying cylinder.

17. The drying section of claim 14, wherein the other press roll is spaced a slight distance from the other of the final drying cylinder of the upstream one of the drying groups and the first drying cylinder of the downstream one of the drying groups defining a short open transfer path for the web between them.

18. The drying section of claim 14, wherein the press rolls are of substantially smaller diameter than the respective drying cylinders adjacent the press rolls.

19. The drying section of claim 14, wherein at least one of the press rolls and the adjacent drying cylinder is supported for moving the one press roll and the adjacent drying cylinder in position toward and away from the other for defining the press nip or opening the press nip between them.

20. The drying section of claim 14, wherein at least one of the press rolls is a suction roll.

21. The drying section of claim 14, further comprising a respective guide roll between adjacent drying cylinders in each of the first and second drying groups, for guiding the respective wire around the guide rolls and wrapping the wire around the drying cylinders in the drying group.

22. A drying section of a paper making machine with additional web dewatering, the drying section comprising:

at least a first and a second drying group, each of the drying groups including a plurality of heatable drying cylinders having a heatable surface, each of the drying groups having an upstream end at which a paper web enters the drying group to move through the drying group in the downstream direction, and having a downstream end where the paper web leaves the drying group;

web guide means for guiding the paper web to be dried over the surface of the drying cylinders of the drying group and to be moved from the upstream to the downstream ends of the drying group;

at least one dryer wire in each drying group; wire guide means guiding the dryer wire to support the paper web against the heatable surfaces of the drying cylinders within the drying group and for the wire to move with the web through the drying group;

a press roll located in the drying section, the press roll being supported for pressing the web against one of the drying cylinders and for defining a press nip between the press roll and the one drying cylinder; the web guide means guiding the web through the press nip;

a web dewatering belt passing around the press roll and passing together with the paper web through the press nip between the press roll and the one drying cylinder such that the press roll presses on the dewatering belt and the web for additionally dewatering the web passing around the one drying cylinder.

* * * * *